US006955535B2

(12) United States Patent
Diebold

(10) Patent No.: US 6,955,535 B2
(45) Date of Patent: Oct. 18, 2005

(54) ARRAY FOR AN AUTOMATIC FIRING DEVICE FOR A GAS OR OIL BURNER

(75) Inventor: Alexander Diebold, Rastatt (DE)

(73) Assignee: Siemens Building Technologies AG, Zurich (CH)

( * ) Notice: Subject to any disclaimer, the term of this patent is extended or adjusted under 35 U.S.C. 154(b) by 0 days.

(21) Appl. No.: 10/471,138

(22) PCT Filed: Mar. 4, 2002

(86) PCT No.: PCT/IB02/00621

§ 371 (c)(1),
(2), (4) Date: Feb. 23, 2004

(87) PCT Pub. No.: WO02/070954

PCT Pub. Date: Sep. 12, 2002

(65) Prior Publication Data

US 2004/0121275 A1 Jun. 24, 2004

(30) Foreign Application Priority Data

Mar. 6, 2001 (DE) ..... 101 10 810

(51) Int. Cl.[7] ..... F23N 3/00

(52) U.S. Cl. ..... 431/18; 431/12; 431/89; 137/101.19; 137/486

(58) Field of Search ..... 431/12, 18, 13, 431/17, 89, 90; 137/554, 486, 100, 101.19; 110/234, 204; 251/129.04

(56) References Cited

U.S. PATENT DOCUMENTS 4,375,950 A 3/1983 Durley, III
4,645,450 A * 2/1987 West ..... 431/12
4,926,765 A * 5/1990 Dreizler et al. ..... 110/234
6,048,193 A 4/2000 Juntunen
6,279,870 B1 * 8/2001 Welz et al. ..... 251/129.04

FOREIGN PATENT DOCUMENTS

| | | |
|---|---|---|
| DE | 2753520 | 6/1979 |
| DE | 9300162 | 3/1993 |
| DE | 3900151 | 7/1997 |
| DE | 19839160 | 3/2000 |
| EP | 0339135 | 11/1989 |
| EP | 0556694 | 8/1993 |
| EP | 0644376 | 3/1995 |
| WO | WO 99/24757 | 5/1999 |

* cited by examiner

*Primary Examiner*—Alfred Basichas
(74) *Attorney, Agent, or Firm*—Maginot, Moore & Beck

(57) ABSTRACT

Automatic operation of a blower burner (5) suitable for liquid and/or gaseous fuels for the generation of heat energy in a furnace (1) is monitored by an automatic regulating device (35). The automatic regulating device (35) comprises an automatic firing device array (26) and an actuating drive (27) located in a common housing (29). The automatic regulating device (35) is connected to a furnace control device (1A), monitoring probes (39) and a fuel feeding and dosing device (12) by means of a terminal sleeve (36) in the housing (29). Based on the signals from the monitoring probes (39), the automatic regulating device (35) regulates the amount of air flowing into the combustion chamber (7) depending on the amount of fuel required for heat output so that optimal fuel combustion takes place in the combustion chamber (7) (for instance combined electronic control).

21 Claims, 2 Drawing Sheets

ARRAY FOR AN AUTOMATIC FIRING DEVICE FOR A GAS OR OIL BURNER

This application claims priority under 35 U.S.C. §119 to PCT Application No. PCT/IB02/00621 filed on Mar. 4, 2002 which claimed priority to German Application No. 10110810.9 filed on Sep. 6, 2003.

BACKGROUND OF THE INVENTION

The invention relates to an arrangement of an automatic firing apparatus as set forth in the classifying portion of claim 1.

Such automatic firing apparatuses are used for controlling and monitoring a fan burner for liquid and/or gaseous fuels, in order to ensure combustion of the fuel which is safe and as optimum as possible and are arranged on a housing portion of the fan burner.

For safe reliable operation the fan burner, referred to for brevity as the burner, requires an extensive control apparatus, the automatic firing apparatus, in which respect all regulating sections of the automatic firing apparatus are monitored from the safety engineering point of view in order immediately to detect any misfunction on the part of a component of the burner.

An arrangement of the kind set forth in the opening part of this specification is known from EP 0 556 694 A1. The automatic firing apparatus is disposed separately from the other parts of the burner in a separate housing and is connected to the burner by means of a large number of electrical control and signal lines. The automatic firing apparatuses are distinguished by a reset button. In the event of a fault detected by the automatic firing apparatus operation of the burner is interrupted immediately and the supply of fuel is shut down. In that situation the reset button lights up red in order to indicate the fault. The reset button when lit red is required for resetting the automatic firing apparatus into the initial condition.

It can be seen from DE-OS No 27 53 520 that, for optimum combustion of the fuel, the amount of air supplied must be regulated, in dependence on the amount of fuel. A throttle flap which is arranged in the air supply duct of the burner and which is rotatable about an axis controls the amount of air in accordance with the angular position of the throttle flap. A setting drive determines the angular position of the throttle flap in the air supply duct, the setting drive receiving suitable command signals from a regulating device during burner operation in order to adapt the supply of air to the burner power. Further improvements for reducing the production of pollutants in burners are described in EP 0 644 376 A1.

Further information regarding the regulation of burners with liquid and/or gaseous fuel can be found in DE 39 00 151 C1 and DE 198 39 160 A1.

The regulations relating to operational safety and environmental protection necessarily require the burners to be fitted with an automatic firing apparatus for reducing the risk of fire or explosion, and a regulating means for regulating the supply of air for reducing the level of pollutants discharged to the environment.

It is also known that setting drives, regulating devices and automatic firing apparatuses are generally offered on the market by various manufacturers, as separate components. Unfortunately the items of equipment are not completely compatible so that, when equipping the burner with the automatic firing apparatus and the setting drive for regulating the amount of air, it is necessary to pick out at least a suitable pairing from what is on offer. As the service life of the burner is very great, at 10 and more years, securing a supply of spare parts, such as for example the automatic firing apparatuses, the setting drives and so forth, is also a complex and expensive consideration.

The object of the invention is to provide a simplified inexpensive form of equipment for fan burners.

In accordance with the invention the specified object is attained by the features recited in the characterising portion of claim 1. Advantageous configurations of the invention are set forth in the appendant claims.

Embodiments of the invention are described in greater detail hereinafter and illustrated in the drawing in which.

Figure 1:
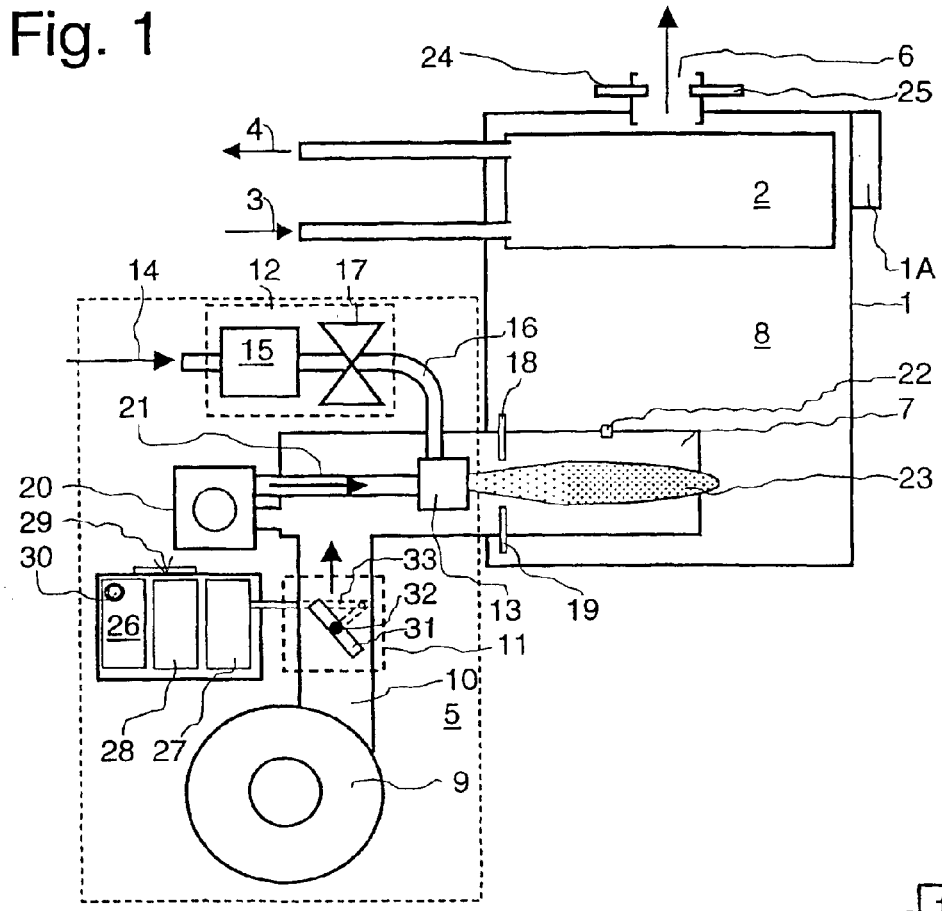
FIG. 1 shows a boiler with a fan burner.

In FIG. 1 reference 1 denotes a boiler, reference 1A denotes a boiler control, reference 2 denotes a water tank, reference 3 denotes a feed line and reference 4 denotes a discharge line, reference 5 denotes a fan burner, hereinafter referred to as the burner 5 for the sake of brevity, and reference 6 denotes an exhaust gas duct. The boiler 1 serves for heating water in the water tank 2. Cold water is supplied to the water tank 2 by means of the feed line 3 while heated water for heating a building and/or for heating service water or water for domestic use flows through the discharge line 4. The temperature of the water in the water tank 2 is monitored by the boiler control 1A. The burner 5 is arranged at the boiler 1 and projects with its combustion chamber 7 into a firing chamber 8 of the boiler 1. As soon as the temperature of the water drops the boiler control 1A calls for heat energy from the burner 5. The heat energy is produced by the burner 5 by virtue of the combustion of liquid and/or gaseous fuels. Hot combustion gases from the combustion chamber 7 flow around the water tank 2 in the firing chamber 8 and there give off their heat energy. A large part of the heat energy produced is used to heat the water. After that the combustion gases escape into the open air through the exhaust gas duct 6.

The burner 5 has a fan 9, an air duct 10 with a throttle device 11, a conveyor and metering device 12 for the fuel and an atomiser nozzle 13 arranged in the combustion chamber 7. The conveyor and metering device 12 conveys the fuel in the direction of an arrow 14 by means of a fuel pump 15 or by means of a suitable gas pressure. A metering valve 17 which is fitted into a fuel line 16 between the fuel pump 15 and the atomiser nozzle 13 regulates or interrupts the flow of fuel. The fuel is passed in a metered fashion by way of the fuel line 16 to the atomiser nozzle 13 where the fuel is very finely divided by means of compressed air so that the fuel-air mixture can be fired by means of an electrical spark between ignition electrodes 18 and 19. An air compressor 20 draws air out of the air duct 10 and urges the compressed air through an air conduit 21 into the atomiser nozzle 13. The air required for combustion is pressed by the fan 9 through the air duct 10 to the combustion chamber 7, the throttle device 11, by varying the cross-section of the air duct 10, metering the amount of air in accordance with the heat output required, in such a way that the fuel supplied to the atomiser nozzle 13 by the conveyor and metering device 12 undergoes combustion in the optimum fashion. A flame probe 22 monitors the combustion process in the combustion chamber 7. For example when burning heating oil, the flame probe 22, in the form of a photoelectric cell, detects the intensity of emission of ultraviolet or infrared light of a flame 23 or, when burning natural gas, the flame probe 22 in the form of an ionisation probe detects the electrical conductivity of the gases in the combustion chamber 7, such conductivity being increased by the flame 23. Furthermore in the exhaust gas duct 6 the oxygen content can be additionally measured by means of an exhaust gas probe 24 ('λ-probe') and/or the temperature of the exhaust gases can be measured by means of a sensor 25.

According to the amount of heat required by the boiler 1 the burner 5 has to be set in operation, the heat output altered or shut down. So that these complicated procedures take place automatically in the burner 5 the burner is equipped with a monitoring circuit, an automatic firing apparatus 26. It regulates the time at which the pumps 9, 11, 15 are switched on and off and the correct ratio of the amounts of air and fuel, having regard to the signals communicated by the probes 22, 24, 25, and it monitors the presence of the flame 23. At least the amount of air is adjusted by means of the throttle device 11 by way of a setting drive 27. For safety considerations the automatic firing apparatus 26 checks the function of each component of the regulating sections and the position of the setting drive 27. For the sake of clarity, the electrical lines for the electrical signals and the supply with electrical power are not shown in the drawing in FIG. 1.

The automatic firing apparatus 26 and the setting drive 27, with a mains unit 28 for the power supply to the automatic firing apparatus 26 and the setting drive 27 and the other electrical and electronic components, are disposed in a common housing 29. A wall of the housing 29 has a reset button 30 of the automatic firing apparatus 26, which is to be actuated manually from the exterior.

The setting drive 27 is coupled mechanically to the throttle device 11 of the air duct 10. Under the control of the automatic firing apparatus 26, by means of the throttle device 11, the setting drive 27 alters the cross-section of the air duct 10 and thus regulates the air through-put so that the combustion process takes place under optimum conditions for the level of heat output required by the boiler control 1A. In an embodiment the setting drive 27 which is equipped with an electrical drive alters the duct cross-section by means of a throttle flap 32 arranged in the air duct 10 rotatably about an axis 31. The position of the setting drive is mechanically transmitted to the throttle flap 32 by means of a linkage 33.

Figure 2:
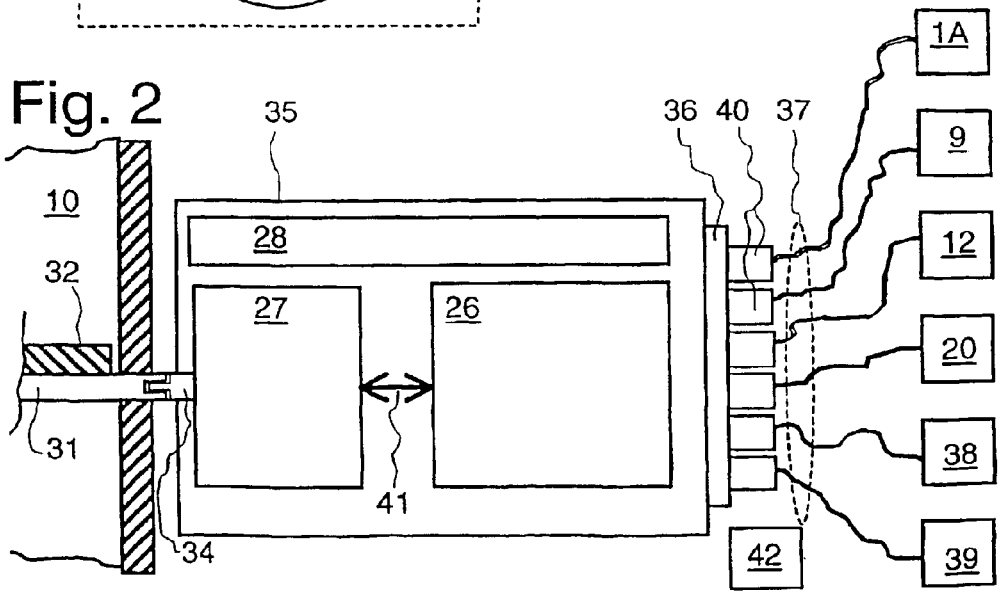
FIG. 2 shows an automatic setting device.

In the embodiment shown in FIG. 2 a setting drive shaft 34 engages for example with a tongue directly into a groove in the shaft 31 in such a way that the position of the throttle flap 32 in the air duct 10 directly corresponds to the rotary angle or position of the setting drive shaft 34 of the setting drive 27. In both constructions the position of the throttle flap 32 or the setting drive shaft 34 is continuously communicated to the automatic firing apparatus 26.

At least the automatic firing apparatus 26, the setting drive 27 and the mains unit 28 are disposed in the housing 29 (FIG. 1) and form an automatic setting device 35. A connecting socket 36 (FIG. 2) on the housing 35 forms lead-through means for electrical lines 37 for the electrical signals and/or the power supply for the components of the burner 5 which are to be controlled (FIG. 1). The components to be controlled include for example the fan 9, the conveyor and metering device 12, the air compressor 20, an ignition device 38 for the ignition electrodes 18 (FIG. 1), 19 (FIG. 1) and monitoring probes 39. Of the monitoring probes 39 at least the flame probe 22 (FIG. 1) is connected. Depending on the respective design of the burner 5 the exhaust gas probe 24 (FIG. 1) and/or the temperature sensor 25 (FIG. 1) are additionally connected. In addition the boiler control 1A is connected with the line 37 to the automatic setting device 35. The lines 37 contact the connecting socket 36 by means of plugs 40 and/or by means of terminals so that the electrical connections can be easily separated when replacing one of the components.

The described arrangement of the automatic firing apparatus 26 and the setting drive 27 in the automatic setting device 35 has a large number of advantages. Installation of the automatic setting device 35 is less expensive in comparison with the installation of a conventional pair, made up of completely independently units, comprising the automatic firing apparatus 26 and the setting drive 27. In addition electrical connections 41 between the automatic firing apparatus 26 and the setting drive 27 within the automatic setting device 35 are very short and in any use are laid in the optimum fashion in terms of interference and faults. The expenditure for achieving electromagnetic compatibility is lower as fewer electrical lines 37 are passed into and out of the automatic setting device 35, in comparison with the conventional arrangement. Not least there are further savings by virtue of the joint use of units, for example the mains unit 28, and logic elements in the control.

In another embodiment in the automatic setting device 35 the automatic firing apparatus 26 is pluggably connected in the form of a module to the mains unit 28 and the setting drive 27. That means that, after removal of the module, the automatic setting device 35 can also be used as an external setting drive 42. The external setting drive 42 is connected for example by way of electrical lines (not shown in FIG. 2) to the connecting socket 36 of the automatic setting device 35 equipped with the module of the automatic firing apparatus 26, and controlled thereby.

Figure 3:
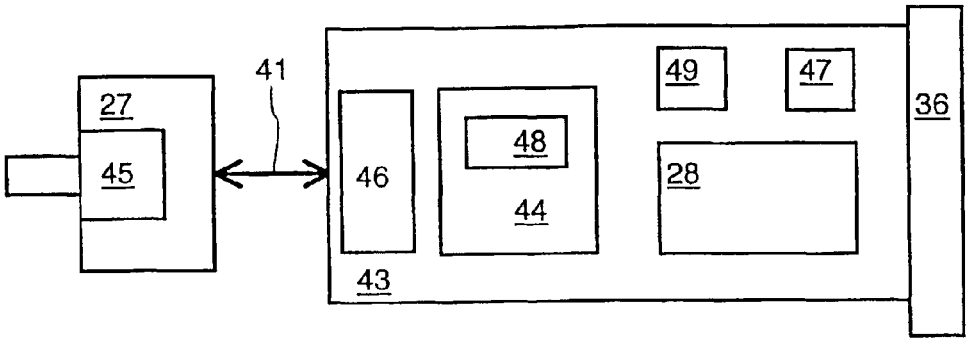
FIG. 3 shows a structure of the automatic setting device.

An inexpensive design configuration of the automatic setting device 35 is shown in FIG. 3. Arranged on a printed circuit board 43 in the housing 29 (FIG. 1) are the circuits of the automatic firing apparatus 26 (FIG. 2) and the setting drive 27, the mains unit 28 and the connecting socket 36. A logic unit 44 (for example a microprocessor 44') is provided for performing the functions of the automatic firing apparatus 26 and for actuating and monitoring a setting motor 45 of the setting drive 27 by way of the connections 41. An interface 46 between the logic unit 44 and the connections 41 or the connecting socket 36 matches the levels of the internal electrical signals to the levels of the setting motor 45 and the external components connected by way of the connecting socket 36. Also arranged on the printed circuit board 43 are protective devices 47 necessary for electromagnetic compatibility (EMC). In an embodiment of the automatic setting device 35 (FIG. 2) the microprocessor 44' is used as the logic unit 44. All parameters and functions are stored in a programmable memory 48 to which the microprocessor 44' has access. That arrangement has the advantage that the automatic setting device 35 can be matched to the respective type of burner 5 (FIG. 1) by altering parameters or program portions in the memory 48.

In another embodiment a switch 49 is additionally arranged in the interior of the automatic setting device 35. In the one position the switch 49 is adapted for blocking the functions of the automatic firing apparatus 26 and for directly connecting control circuits of the setting motor 45 to the connecting socket 36. That makes it possible to use the automatic setting device 35 as an external setting drive 42 (FIG. 2).

Figure 4:
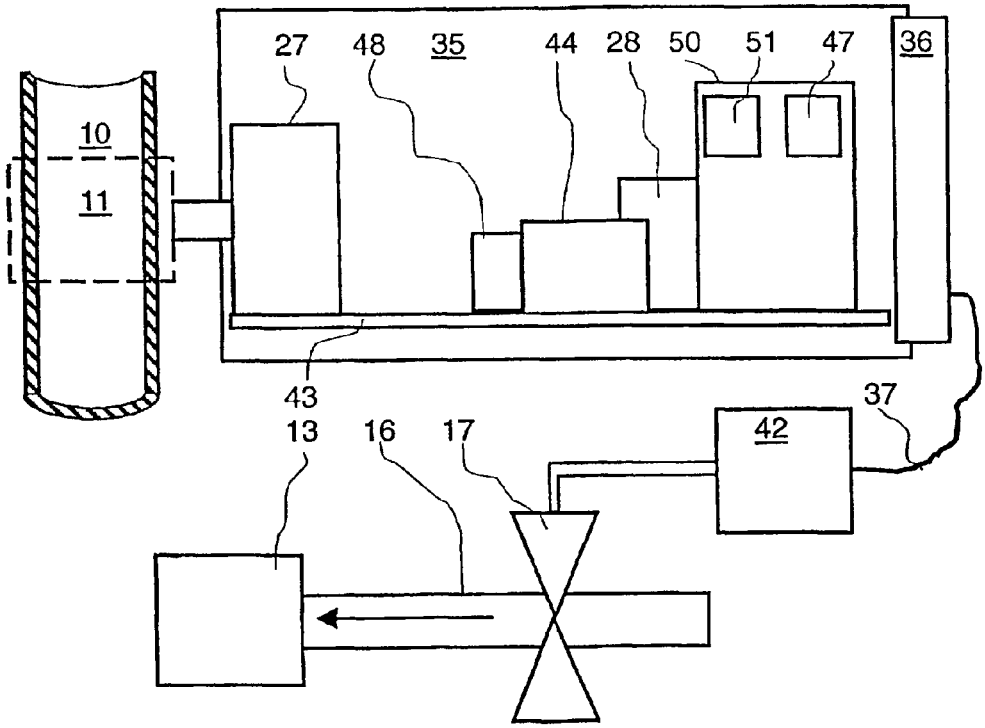
FIG. 4 shows the automatic setting device with an external setting drive.

In another embodiment as shown in FIG. 4 the automatic setting device 35 additionally includes at least one actuation module 50 for the actuation of a further external setting drive 42. The electrical lines 37 for the transmission of the drive power for the external setting drive 42 and signals for reporting back on the condition of the external setting drive 42 are passed by way of the connecting socket 36 to the automatic setting device 35. The external setting drive 42 is fed for example by the mains unit 28.

The actuation module 50 is for example a separate circuit portion which can be plugged on to the printed circuit board 43 and which performs all functions of the actuation module 50 or only contains a setting drive interface 51 with the EMC-protection circuits 47 for the external setting drive 42, wherein the functions of the actuation module 50 are contained in the form of software in the program of the microprocessor 44' or in the form of parameters in the memory 48. The actuation module 50 is adapted to receive and process the report signals for controlling and monitoring the position of the external setting drive 42, in such a way that the instantaneous position of the external setting drive 42 is dependent, following a predetermined function, on the instantaneous position of the internal setting drive 27. The automatic setting device 35 with the external setting drive 42 forms an electronic composite control arrangement. The predetermined function of that electronic composite control arrangement can be inputted for example in the form of a table into the memory 48 of the microprocessor 44'.

The external setting drive 42 actuates for example the metering valve 17 in the fuel conduit 16 leading to the atomiser nozzle 13 of the burner 5 (FIG. 1) for liquid and/or gaseous fuel under the control of the automatic setting device 35 so that the amount of heat required by the boiler control 1A (FIG. 1) is produced. The position of the external setting drive 42 determines the amount of fuel supplied to the burner 5, by means of the metering valve 17. The air through-put in the air duct 10 must be adjusted in the electronic composite arrangement over the entire range of adjustment of the heat output of the burner 5 by means of the throttle device 11 which is adjustable with the internal setting drive 27 so that the fuel undergoes optimum combustion with the predetermined amount of air in the combustion chamber 7 (FIG. 1).

As the function table for the electronic composite control arrangement in the memory 48 is interchangeable the electronic composite control arrangement enjoys a substantially greater degree of flexibility than a mechanical composite control arrangement if the automatic setting device 35 is to be matched to the properties of the various types of burner 5.

By way of example DE 39 00 151 C1 which has been referred to in the opening part of this specification describes a mechanical composite control arrangement in which a single setting motor adjusts the throttle device 11 and the metering valve 17, wherein the throttle device 11 and the metering valve 17 are so coupled by way of displaceable levers and rods that the optimum fuel-air ratio is ensured for the entire output adjusting range of the burner 5.

What is claimed is:

1. An arrangement of an automatic firing apparatus for monitoring the operation of a fan burner suitable for liquid and/or gaseous fuels comprising a combustion chamber with a regulated supply of an amount of air predetermined to be sufficient for combustion of the fuel, wherein the amount of air flowing in an air duct leading to the combustion chamber is regulatable by a throttle device which alters the duct cross-section and wherein the amount of air is determined by the position of a setting drive arranged externally on the air duct and mechanically altering the duct cross-section, wherein at least circuits performing the functions of the automatic firing apparatus together with the setting drive and a mains unit configured to supply power to the circuits of the automatic firing apparatus and the setting drive are disposed in a housing of an automatic setting device, a setting drive shaft of the setting drive projects out of the housing and the automatic setting device is arranged at the fan burner.

2. An arrangement as set forth in claim 1 wherein the throttle device is a throttle flap rotatable about a shaft and arranged in the air duct and the throttle flap is connected mechanically to the setting drive shaft of the setting drive.

3. An arrangement as set forth in claim 2 wherein, in the housing, the automatic firing apparatus is connected pluggably as a module to the mains unit and the setting drive.

4. An arrangement as set forth in a claim 3 wherein a switch is arranged in the automatic setting device and in one position the switch is adapted to block the functions of the automatic firing apparatus and to directly connect circuits of the setting drive to external connection points of a connecting socket.

5. An arrangement as set forth in claim 2 wherein a logic unit with the circuits of the automatic firing apparatus and the setting drive with the mains unit are arranged on a printed circuit board in the housing.

6. An arrangement as set forth in claim 5 wherein the logic unit is a microprocessor and the microprocessor is adapted at least for performing the functions of the automatic firing apparatus and for actuating and monitoring the setting drive, wherein parameters and program portions for performing the functions of the automatic firing apparatus and for actuating and monitoring the setting drive are stored in a memory connected to the microprocessor.

7. An arrangement as set forth in claim 6 wherein a switch is arranged in the automatic setting device and in one position the switch is adapted to block performance of the functions of the automatic firing apparatus and to directly connect circuits of the setting drive to external connection points of a connecting socket.

8. An arrangement as set forth in claim 7 wherein the automatic setting device includes at least one actuation module connected to an external setting device and that the actuation module is adapted to receive and process signals for controlling and monitoring the external setting drive, in such a way that the automatic setting device and the external setting drive form an electronic composite control means in which a position of the external setting drive, which is predetermined by the actuation module, is a predetermined function of the position of the internal setting drive disposed in the automatic setting device.

9. An arrangement as set forth in claim 5 wherein a switch is arranged in the automatic setting device and in one position the switch is adapted to block the functions of the automatic firing apparatus and to directly connect circuits of the setting drive to external connection points of a connecting socket.

10. An arrangement as set forth in claim 2 wherein a switch is arranged in the automatic setting device and in one position the switch is adapted to block the functions of the automatic firing apparatus and to directly connect circuits of the setting drive to external connection points of a connecting socket.

11. An arrangement as set forth in claim 2 wherein the automatic setting device includes at least one actuation module connected to an external setting device and that the actuation module is adapted to receive and process signals for controlling and monitoring the external setting drive, in such a way that the automatic setting device and the external setting drive form an electronic composite control means in which a position of the external setting drive, which is predetermined by the actuation module, is a predetermined function of the position of the internal setting drive disposed in the automatic setting device.

12. An arrangement as set forth in claim 1 wherein the automatic setting device includes at least one actuation module connected to an external setting device and that the actuation module is adapted to receive and process signals for controlling and monitoring the external setting drive, in such a way that the automatic setting device and the external setting drive form an electronic composite control means in which a position of the external setting drive, which is predetermined by the actuation module, is a predetermined function of the position of the internal setting drive disposed in the automatic setting device.

13. An arrangement as set forth in claim 1 wherein a switch is arranged in the automatic setting device and in one position the switch is adapted to block the functions of the automatic firing apparatus and to directly connect circuits of the setting drive to external connection points of a connecting socket.

14. An arrangement as set forth in claim 1 wherein, in the housing, the automatic firing apparatus is connected pluggably as a module to the mains unit and the setting drive.

15. An arrangement as set forth in claim 14 wherein a switch is arranged in the automatic setting device and in one position the switch is adapted to block the functions of the automatic firing apparatus and to directly connect circuits of the setting drive to external connection points of a connecting socket.

16. An arrangement as set forth in claim 1 wherein a logic unit with the circuits of the automatic firing apparatus and the setting drive with the mains unit are arranged on a printed circuit board in the housing.

17. An arrangement as set forth in claim 16 wherein a switch is arranged in the automatic setting device and in one position the switch is adapted to block the functions of the automatic firing apparatus and to directly connect circuits of the setting drive to external connection points of a connecting socket.

18. An arrangement as set forth in claim 16 wherein the logic unit is a microprocessor and the microprocessor is adapted at least for performing the functions of the automatic firing apparatus and for actuating and monitoring the setting drive, wherein parameters and program portions for performing the functions of the automatic firing apparatus and for actuating and monitoring the setting drive are stored in a memory connected to the microprocessor.

19. An arrangement as set forth in claim 18 wherein a switch is arranged in the automatic setting device and in one position the switch is adapted to block the functions of the automatic firing apparatus and to directly connect circuits of the setting drive to external connection points of a connecting socket.

20. An arrangement as set forth in claim 19 wherein the automatic setting device includes at least one actuation module connected to an external setting device and that the actuation module is adapted to receive and process signals for controlling and monitoring the external setting drive, in such a way that the automatic setting device and the external setting drive form an electronic composite control means in which a position of the external setting drive, which is predetermined by the actuation module, is a predetermined function of the position of the internal setting drive disposed in the automatic setting device.

21. An arrangement as set forth in claim 1 wherein the automatic setting device includes at least one actuation module connected to an external setting device and that the actuation module is adapted to receive and process signals for controlling and monitoring the external setting drive, in such a way that the automatic setting device and the external setting drive form an electronic composite control means in which a position of the external setting drive, which is predetermined by the actuation module, is a predetermined function of the position of the internal setting drive disposed in the automatic setting device.

* * * * *